United States Patent [19]

Smith

[11] 4,257,587

[45] Mar. 24, 1981

[54] DOCUMENT REGISTERING AND FEEDING APPARATUS

[75] Inventor: Wayne R. Smith, Henrietta, N.Y.

[73] Assignee: Xerox Corporation, Stamford, Conn.

[21] Appl. No.: 956,119

[22] Filed: Oct. 30, 1978

[51] Int. Cl.[3] ..... B65H 9/16; B65H 5/06

[52] U.S. Cl. ..... 271/236; 29/132; 271/242; 271/251; 271/264

[58] Field of Search ..... 271/251, 250, 248, 236, 271/238, 242, 272–274, 265, 275, 264, 208, 109, 131, 161, 165; 29/132

[56] References Cited

U.S. PATENT DOCUMENTS

| | | | |
|---|---|---|---|
| 2,797,982 | 10/1956 | Noon | 271/251 |
| 3,815,899 | 6/1974 | Hatzmann | 271/80 |
| 3,845,951 | 11/1974 | Hamaker | 271/243 |
| 3,877,804 | 4/1975 | Hoppner | 271/236 X |
| 3,907,276 | 9/1975 | Gerbasi | 271/251 X |
| 3,908,986 | 9/1975 | Bleau | 271/251 X |
| 3,961,785 | 6/1976 | Gall | 271/165 X |
| 3,970,299 | 7/1976 | Berger et al. | 271/250 |
| 3,980,296 | 9/1976 | Craft et al. | 271/251 |
| 4,049,256 | 9/1977 | Church et al. | 271/251 X |
| 4,052,054 | 10/1977 | Cardwell et al. | 271/251 X |

OTHER PUBLICATIONS

Gutteling, "Document Aligning Device . . .", *IBM Technical Disclosure Bulletin,* vol. 16, No. 11, Apr. 1974, pp. 3676–3677.

Lennon et al., "Sheet Positioning Apparatus", *IBM Technical Disc. Bulletin*, vol. 17, No. 10, Mar. 1975, p. 2971.

Harding et al., "Sheet Aligner", *IBM Technical Disclosure Bulletin*, vol. 18, No. 5, Oct. 1975, pp. 1307–1308.

Hubbard et al., "Copier Controls", *IBM Technical Disclosure Bulletin*, vol. 19, No. 5, Oct. 1976, pp. 1589–1590.

*Primary Examiner*—Bruce H. Stoner, Jr.

[57] ABSTRACT

A document registering and feeding apparatus comprising a flexible registration and feeding member for driving a document into registration engagement with a side registration member and for feeding a document in a direction substantially parallel to the side registration member. The flexible registration and feeding member comprises a flexible rotatable drive shaft and a generally cylindrical deformable scuffer wheel fixed to one end of the drive shaft, the wheel being in pressure contact with the base surface and adjacent to but spaced from the side registration member.

16 Claims, 8 Drawing Figures

DOCUMENT REGISTERING AND FEEDING APPARATUS

CROSS REFERENCE TO RELATED APPLICATION

U.S. application Ser. No. 956,129 filed concurrently herewith to Document Registering and Feeding Apparatus for document registering and feeding apparatus.

BACKGROUND OF THE INVENTION

This invention relates to a document registering and feeding apparatus. This apparatus is particularly adapted for use as a document feeder for automatic reproduction machines.

In the copying art is has frequently been found advantageous to support or transport the original document to be reproduced over a stationary platen while recording an image of the stationary original upon a photosensitive surface. In this manner, copies of the original can be reproduced from the photosensitive surface. Numerous document feeders for use with reproducing machines are known in the art. Representative of the broad prior art in this area of document feeders for placing a document on a transparent viewing platen are U.S. Pat. No. 3,499,710 to Sahley; U.S. Pat. No. 3,556,512 to Fackler; U.S. Pat. No. 3,674,363 to Baller et al; and U.S. Pat. No. 3,790,158 to Summers et al. The above first named patent shows the use of friction rolls for transporting the document over the platen. The remaining patents show the use of belt type transport devices.

PRIOR-ART-STATEMENT

Semiautomatic document feeding or registering devices are also known in the prior art.

Volume 19, No. 5, October, 1976, IBM Technical Disclosure Bulletin, pages 1589 to 1591 discloses the use of a set of entry aligner rolls to align original documents to the correct orientation in a semiautomatic feed for a document copier.

Volume 17, No. 10, March, 1975, IBM Technical Disclosure Bulletin, page 2971 and IBM U.S. Pat. No. 3,908,986 disclosure an aligner mechanism comprising an eccentrically mounted and driven cylindrical feed roll rotating with a cooperating pinch device for providing intermittent feeding of documents with both lead edge and side edge registration.

Volume 16, No. 11, April, 1974, IBM Technical Disclosure Bulletin, pages 3676, 3677 discloses a document alignment device for transporting documents in two directions which comprises a hollow deformable aligner wheel positioned at an angle of 45° to the vertical for feeding rotation with the paper being fed. A circle segment depression in the base plate provides room for the aligner wheel to protrude through the plane of the base plate.

In addition, Volume 18, No. 5, October, 1975, IBM Technical Disclosure Bulletin, pages 1307 and 1308 disclose two sets of aligner rolls. A pair of fixed drive rolls which are driven against idler rolls with a sheet to be transported in between are used to align sheets against an edge. The rolls are at an angle of approximately 45° to the guide edge. After alignment a second set of drive rolls advances the sheet while maintaining it in alignment with the reference edge.

U.S. Pat. No. 3,970,299 discloses a sheet registry device in which a rotating brush is used to provide corner registration of a sheet. In FIGS. 4 and 5, the brush is shown as being positioned about 45° to the feeding direction and can be mounted on a vertical yoke.

U.S. Pat. No. 3,980,296 discloses a copy reversing or registry mechanism wherein a rear reference edge of the copy is by means of an aligner mechanism moved to a front reference edge. The aligner mechanism includes plural aligner rolls in cooperation with backup rolls, some of the aligner rolls being coupled to the drive by a short flexible coupling.

Other devices for the alignment or feeding of sheets include among others the Wobble Jogger of U.S. Pat. No. 3,907,376 and the Document Alignment Assembly of U.S. Pat. No. 4,049,256.

In U.S. Pat. No. 3,877,804, assigned to the assignee of the present application, a corner registration device for a document feeder is disclosed. In this device a registration means including a first registration barrier extending in a direction parallel to the direction in which the document is to be fed and which contacts the first side of the document is provided. A second registration barrier the closed nip of a set of pinch rolls, is also provided extending normal to the first barrier. The second barrier is adapted to contact a second side of a document when rotation of the pinch rolls during registration of the document is inhibited.

SUMMARY OF THE INVENTION

In accordance with this invention, an improved document registering and feeding apparatus is provided. The feeding and registering apparatus of this invention provides semiautomatic registering and feeding of documents to a viewing platen.

In accordance with a principle feature of this invention a document registering and feeding apparatus comprises a base surface over which a document may be fed together with a side registration member adjacent a portion of said base surface and extending in the direction substantially parallel to the direction in which the document is to be fed. The registration member is adapted to contact the first side of the document and a flexible registration and feeding member for driving a document into registration engagement with the side registration member and for feeding a document in a direction substantially parallel to the side of the registration member is provided. The flexible registration and feeding member comprises a flexible rotatable drive shaft and a generally cylindrical deformable scuffer roll fixed to one end of said of the flexible drive shaft, the wheel being in pressure contact with the base surface and adjacent to but spaced from the side registration member. In addition, drive means are provided to rotate the flexible shaft in a sheet feeding direction to thereby enable the deformable scuffer roll to urge the individual documents against the side registration member and forward them into the reproduction zone.

In accordance with another feature of the invention, the individual documents are simultaneously registered against side registration member while they are being fed in a direction substantially parallel to the side registration member.

In accordance with another feature of the invention a second registration barrier extending substantially normal to said first barrier is provided. This registration barrier is adapted to contact a second side of the documents being fed and in a preferred embodiment comprises the closed nip of at least one set of pinch rolls.

Accordingly it is an object of the present invention to provide an improved sheet registering and feeding apparatus.

It is a further object of this invention to provide a sheet registering and feeding apparatus which simultaneously registers while feeding one edge of the sheet along a direction parallel to its feeding path.

It is another object of this invention to provide a semiautomatic document register and feeding device which will accept individual sheets in virtually any orientation and automatically register them along one edge while feeding them in a forward direction.

These and other objects will become apparent from the following description and drawings.

BRIEF DESCRIPTION OF THE DRAWINGS

Referring now to FIG. 1, there is illustrated a schematic plan view of a compact automatic xerographic copying machine incorporating the document registering and feeding apparatus of the present invention. The copier depicted in FIG. 1 illustrates the various components utilized for xerographically reproducing copies from an original document. Although the registration and feeding apparatus of the present invention is particularly well adapted for use with a document feeder for an automatic xerographic copier, it should become evident from the following description that it is equally well suited for use with a wide variety of electrostatographic copiers and it is not necessarily limited in its application to the particular embodiment or embodiments shown herein.

Basically, the xerographic processor includes a rotatably mounted photosensitive or photoconductive drum 10 which is supported upon a horizontally extended shaft 11. The drum is driven in the direction indicated whereby the photoconductive surface is caused to pass sequentially through a series of xerographic processing stations.

Figure 1:
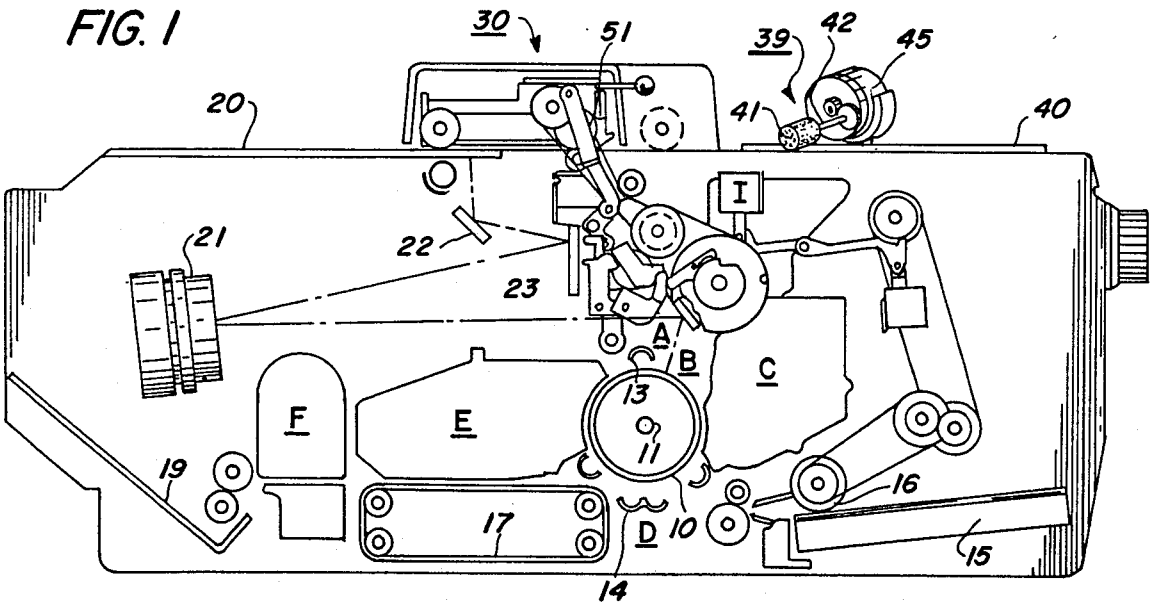
FIG. 1 is a schematic representation of an automatic xerographic compact copier employing the document registering and feeding apparatus of the present invention.

Because the xerographic process is widely known and used in the art, the various processing steps involved will be briefly explained below in reference to FIG. 1. Initially, the photoconductive drum surface is uniformly charged by means of a corona generator 13 positioned within a charging station A located at approximately the 12 o'clock drum position. The charged drum surface is then advanced into an imaging station B wherein a flowing light image of an original document to be reproduced is projected onto the charged drum surface thus recording on the drum a latent electrostatic image containing the original input scene information. Next, subsequent to the exposure step in the direction of drum rotation is a developing station C wherein the latent electrostatic image is rendered visible by applying an electroscopic marking powder (toner) to the photoreceptor surface in a manner well known and used in the art. The now visible image is then forwarded into a transfer station D wherein a sheet of final support material is brought into overlying moving contact with the toner image and the image transferred from the plate to the support sheet by means of a second corona generator 14.

In operation, a supply of cut sheets are supported within the machine by means of a removable paper cassette 15. A pair of feed rollers 16 are arranged to operatively engage the uppermost sheet in the cassette so as to first separate the top sheet from the remainder of the stack and then advance the sheet into the transfer station in synchronous moving relationship to the developed image on the photoconductive plate surface. The motion of the feed rollers is coordinated with that of the rotating drum surface, as well as the other machine components through the main drive system whereby the support sheet is introduced into the transfer station in proper registration with the developed toner image supported on the xerographic plate.

After transfer, but prior to the reintroduction of the imaged portion of the drum into the charging station, the drum surface is passed through a cleaning station E wherein the residual toner remaining on the drum surface is removed. The removed toner particles are collected within a container where they are stored subject to periodic removal from the machine.

Upon completion of the image transfer operation, the toner bearing support sheet is stripped from the drum surface and placed upon a moving vacuum transport 17 which serves to advance the support sheet into a thermal fusing station F wherein the toner image is permanently fixed to the sheet. The copy sheet with the fused image thereon is forwarded from the fuser into a collecting tray 19 where the sheet is held until such time as the operator has occasion to remove it from the machine.

Normally, when the copier is operated in a conventional mode, the original document to be reproduced is placed image side down upon a horizontal transparent viewing platen 20 and the stationary original then scanned by means of a moving optical system. The scanning system fundamentally consists of a stationary lens system 21 positioned below the right hand margin of the platen as viewed in FIG. 1 and a pair of cooperating movable scanning mirrors 22, 23 which are carried upon carriages not illustrated. For a further description and greater details concerning this type of optical scanning system reference is had to U.S. Pat. No. 3,832,057 To Shogren.

The illustrated compact copying apparatus is also provided with a large document copying capability, that is, with the ability to reproduce originals of a size greater than the physical dimensions of the viewing platen. To achieve this end, a document feeder is provided that is movable between a first stored position adjacent to the viewing platen and a second operative or large document handling position over the platen surface. Commensurate with the positioning of the feeder assembly over the platen, the moving optical system is locked in a position to view documents as they are advanced through the document feeder and record a flowing light image of the input information upon the moving photoconductive plate surface. Similarly, the various machine components are conditioned to accept the protracted input so that documents that would ordinarily lie outside the normal viewing domain of the scanning optics can be processed and full sized copies thereof produced.

During normal operations, that is, when the moving optics are utilized to provide a flowing light image of the stationary original, the document feeding assembly is maintained in a stored position (as depicted by the phantom lines shown in FIG. 1) to expose the entire platen surface area and thus provide a maximum working area to the operator. To initiate the large document mode of operation, the machine operator simply advances the document feeding assembly from the stored position to a document feeding position with the feeding assembly extending over the left hand margin of the platen surface.

Once the document feeder is advanced to the operative position and the optical system locked in a viewing position therebeneath a signal is generated indicating that the machine is now in a condition to reproduce copy from a large document input. During production of a copy the original is fed by the document feeder between cooperating feed rollers and pinch rollers, 50 and 51 respectively, which engage the document in friction driving contact and advance the document along the platen surface past the fixed optical system. As the leading edge of the original document is being advanced over the platen, a sensing switch is made sending a signal to the machine logic which, in turn, conditions the machine to produce a single copy from the original. The cooperating feed rollers are adapted to advance the original over the platen at a rate equal to the peripheral speed of the xerographic drum whereby the original input scene information is recorded on the drum in the manner herein described. The advancement of the sheet continues until such time as the trailing edge of the document clears the above-noted switch thus telling the logic system that the document recording operation is completed. For further description and greater details concerning this type of document feeding apparatus reference is had to U.S. Pat. No. 3,900,258 filed in the names of Hoppner et al.

Having thus described a xerographic copying apparatus and more specifically a xerographic apparatus having two modes of operation, the first mode comprising copying a stationary original by means of an optical scanning device, and the second mode comprising copying a moving original by means of a fixed split optical system in conjunction with a document feeder, attention will now be directed to the document registration and feed apparatus of this invention.

Figure 2:
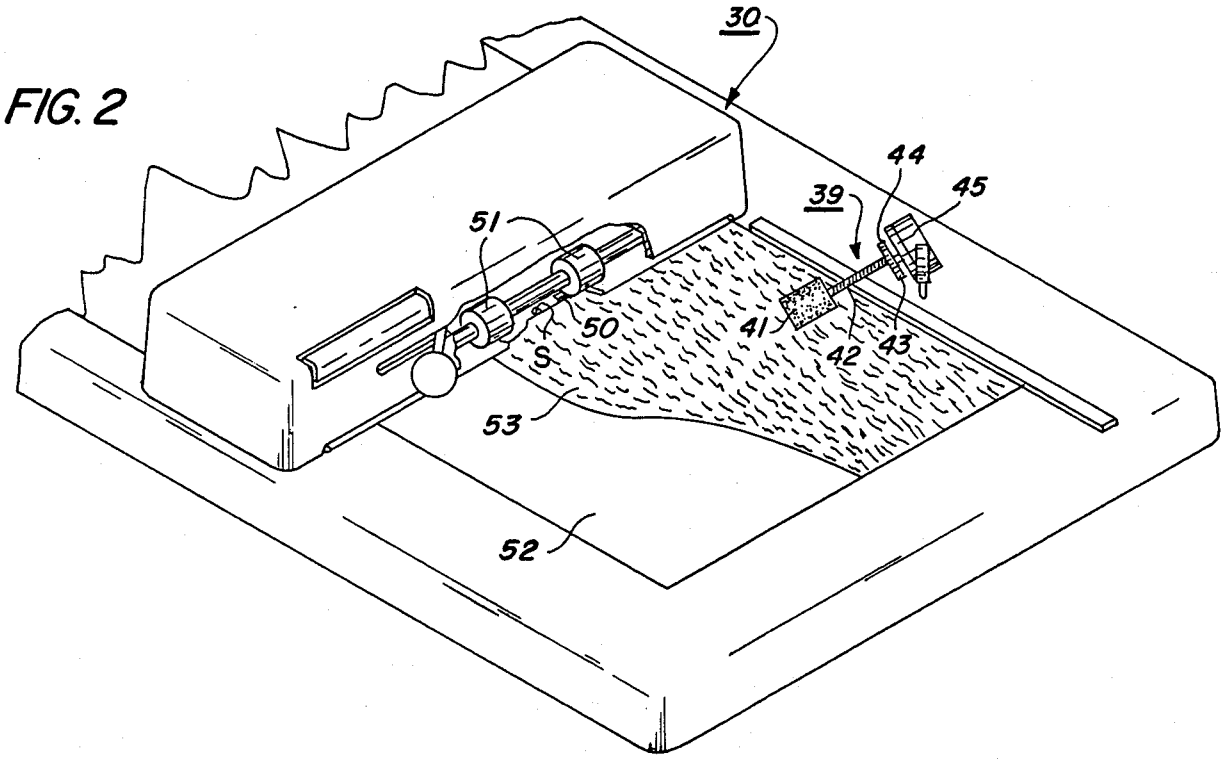
FIG. 2 is a perspective view of a portion of the automatic xerographic compact copier of FIG. 1 with a portion cut away and showing the schematic representation of the feeding of paper by the document registering and feeding apparatus of the present invention.
Figure 3B:
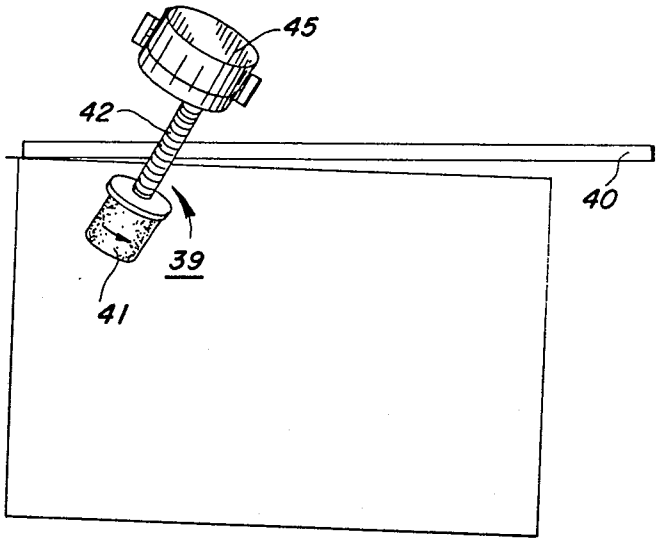
FIGS. 3*a* and 3*b* are schematic representations of the movement of the flexible registration and feeding means.
Figure 3A:
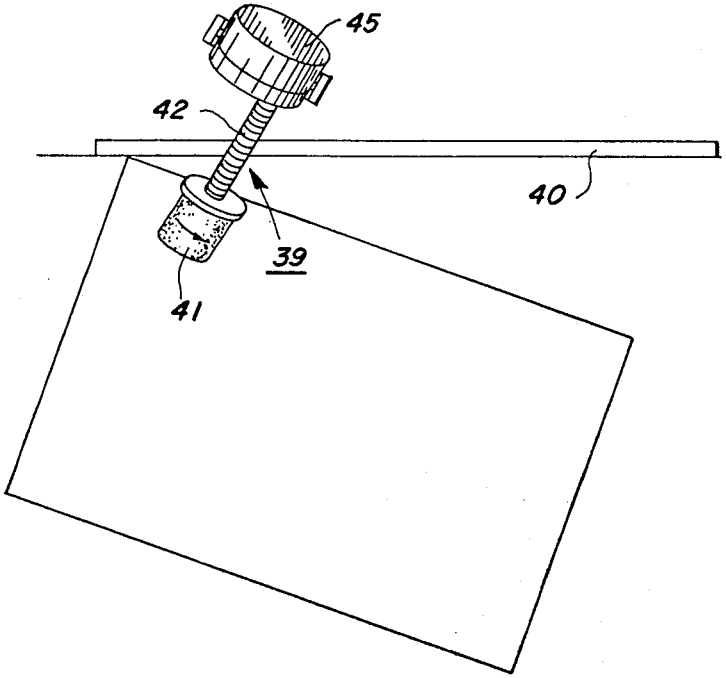
Figure 4:
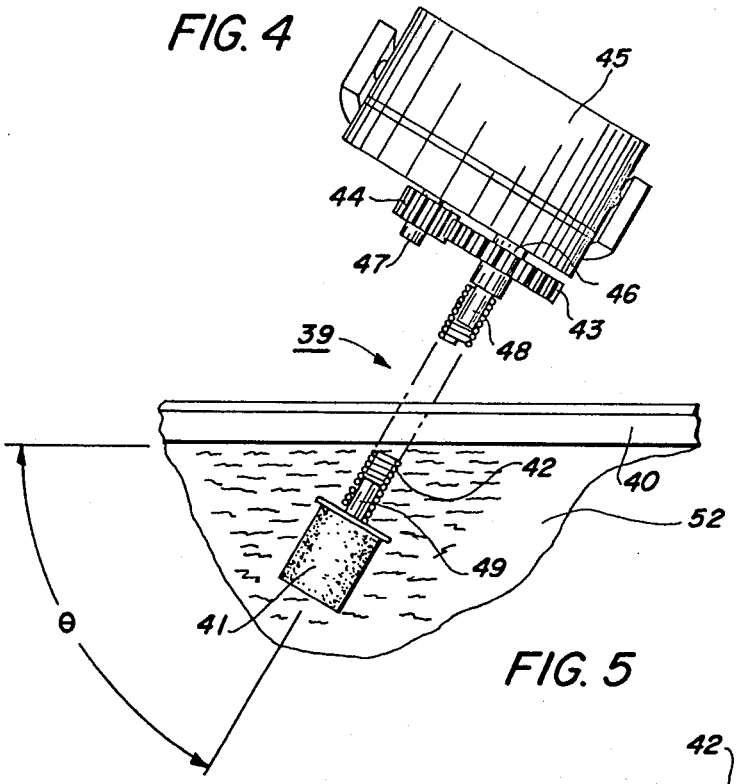
FIG. 4 is a top view of the document registration and feeding apparatus of the present invention.

Referring to FIGS. 2, 3*a*, 3*b* and 4 the feeding and registration apparatus of the present invention is shown in somewhat greater detail. The document registration and feeding member 39 includes a generally cylindrical deformable scuffer roll 41 fixedly attached to shaft 49 which in turn is attached to flexible drive shaft 42. In the registering and feeding operation drive shaft 42 is intermittently rotatably driven in a clockwise direction by motor 45 through drive shafts 46, 47 and 48 by gears 43 and 44. When in operation a document may, for example, be hand fed in a variety of orientations relative to the deformable scuffer roll which, as depicted in FIGS. 3*a* and 3*b*, gently turns a document counterclockwise and urges the document edge most nearly parallel to the side registration member 40 parallel to and in contact with the registration member 40. Once the side of the document is registered against registration member 40 the scuffer roll generally functions to transport the document more in a direction parallel to the registration member 40 and into the nip between the drive rolls 51 and pinch rolls 50. To ensure continuous feeding of each individual sheet the distance between the scuffer roll and the second registration member, the drive and pinch rolls 51 and 50 respectfully, is less than the length of the document to be fed.

The flexible registration and feeding member 39 may be driven independently as depicted in FIGS. 2, 3*a*, 3*b* and 4 or driven directly by the main machine drive mechanism. Typically, its operation is intermittent although it may be continuously driven. In the embodiment described a switch S within the document feeder 30 is placed to activate and inactivate the motor driving the flexible registering and feeding member. When the switch senses the lead edge of a document it inactivates drive motor 45. After the sheet has passed switch S the trailing is sensed and the drive motor 45 is activated. In this manner a small space may be maintained between successively fed individual sheets.

A generally planar support or face plate 52 is provided in the document feeding zone to support the documents being fed. This support may be flat or of any suitable configuration. Typically it is a continuous surface slightly uneven or embossed to minimize the contact between the document being fed and the entire surface over which it is driven. Alternatively a corrugated or waffle plate pattern 53 of FIG. 2 has the additional advantage of providing space by way of the indentations in the surface for the collection of dust, dirt and paper fibers so that they are not fed forward into the machine.

As can be seen from FIGS. 2, 3*a* and 3*b* in particular the driven deformable scuffer roll acts only in conjunction with the face plate and side registration member in providing the registering and feeding functions. Typically the scuffer roll is mounted on a flexible helical spring in such a manner as to give two components of feeding force to the document being fed. One component is perpendicular to the side registration member 40 and the other component is parallel to this registration member. Being mounted and driven by a spring member a small oscillatory motion may be imparted to the scuffer roll while in feeding engagement with the document or the face plate. This motion is due to the apparent resilient or elastic nature of the spring resulting from being rotated in one direction at one end thereof while translating the feeding force to a document with which it is in contact at the opposite end. Thus upon initially capturing a document between the scuffer roll and the face plate the two components of force simultaneously urge the document against the side registration member and toward the second registration member. After the document has been registered against the side registration member there is no need for any significant component of force urging the document against this member.

The registering and feeding of documents may be achieved with any suitable orientation of the flexible registration and feeding member. In typical operation relative to the side registration member and the document being fed the rotatable drive shaft is positioned at an angle $\theta$ as shown in FIGS. 3*a* and 3*b* of from about 45° to about 75° to the side registration member, the angle being measured in the downstream feeding direction. Orientation within this general position provides two significant components of force, a component perpendicular to the side registration member to line the document against the registration edge and the component parallel to the side registration member to propel the document in the forward direction. Generally with an angle of less than 45° the perpendicular component of force is greater than the parallel component of force and the paper tends to buckle against the registration edge. In addition, with the smaller parallel component of force poor feeding of the document may also be experienced. Conversely at an orientation of greater than about 75° poor registration will occur as a result of lower force perpendicular to the registration edge and a high component of force in the feeding direction. With the use of a flexible shaft such as a coil or a helically wound spring and the angle being a dynamic angle a wide operational window for reliably registering and feeding documents is provided.

The normal force applied to the document to be fed by the scuffer roll should be suitable to provide the desired parallel and perpendicular force components to the document being fed. The normal force together with the coefficient of friction of the scuffer roll material will determine the drag force which can be easily measured according to the following relationship. Normal force times the coefficient of friction equals a drag force. The drag force may be measured according to a standard test whereby the document being fed is positioned between the scuffer roll and the face plate and a spring gauge connected to the document in a direction opposite the feeding direction. The force that will just move the paper in the direction opposite the feeding direction while the scuffer roll is rotating is the drag force. In normal feeding of documents the drag force of from about 0.05 to about 0.15 pounds works well for a wide variety of documents of varying sizes, weights and thicknesses. If the drag force is less than about 0.05 pounds, the feeding will slow down and registration will be incomplete. If the drag force is more than about 0.15 a tendency for the document to buckle may exist. To improve feeding in the forward direction the coefficient of friction between the face plate and the paper should be less than the coefficient of friction between the paper and the scuffer roll to thereby enable the paper to slip over the face plate when being driven by the scuffer roll.

The drag force measure may also vary depending on the choice of spring and its relative stiffness or flexibility. Generally with the very rigid spring shaft the opportunity for buckling of thin documents, non-uniform or unstable feeding of documents of varying weights and thicknesses will be increased. A more flexible spring shaft will provide a more stable feeding condition for a wider range of documents of varying sizes and weights. A wide operational window is provided with a spring having a spring rate of 9.5 pounds per inch with zero initial tension. By zero initial tension is essentially meant a spring having an air gap between adjacent coils.

The spring and scuffer roll may be driven at any suitable speed. The system may be run at high or low speeds resulting in faster or slower surface speed. Typically with the scuffer roll rotating at about 400 RPMs a twenty pound weight document may be transported at a rate of about 8 to 10 inches per second.

Figure 5:
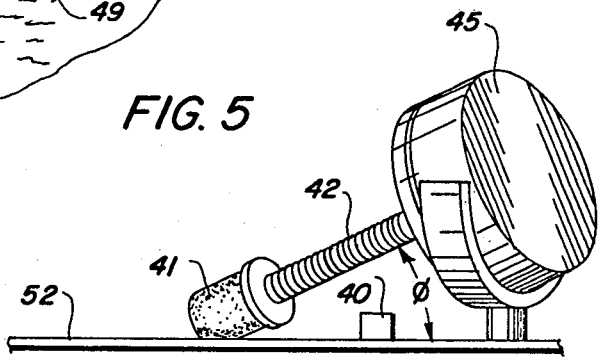
FIG. 5 is an end view of the document registering and feeding apparatus of the present invention.
Figure 6B:
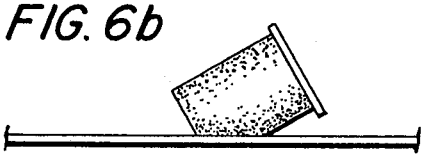
FIG. 6*b* is a side view of the scuffer roll when being deformed to make the outline of FIG. 6*a*.
Figure 6A:
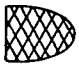
FIG. 6*a* is a top view of the outline of the pattern which the scuffer roll makes when it contacts a sheet being fed.

The flexible registration and feeding member may also be inclined to the vertical rather than being parallel to the plane of the document being fed. This enables one to control to some extent the size of the shoe area or "foot print" of the deformable scuffer roll on the document being fed. With the use of a flexible shaft such as a coil spring this position is also dynamically based. Typically, it is positioned at an angle $\Phi$ of from about 20° to about 40° to the horizontal as shown in FIG. 5. The angle of the scuffer roll, its action on a sheet being fed and the resulting "foot print" of contact are shown in FIGS. 5, 6*a* and 6*b* respectively. The area contact with a deformable scuffer roll as opposed to a line contact enables greater control over the document being fed since a smaller drive force is expended over a larger area. The pressure on any portion of the document is therefore smaller and the opportunity for wrinkling or tearing the document is reduced. Smaller or larger angles of the flexible shaft with respect to the horizontal increase or decrease foot area accordingly which in turn was responsible for more or less wear on the roll for the same normal force.

The deformable scuffer roll may be of any suitable configuration. Typically it is cylindrical in configuration and as discussed above when placed in contact with the face plate the force is sufficient to form a contact or shoe area in the general configuration of an elongated horseshoe or half moon as shown in FIG. 6*a*. A deformable soft roll is used to minimize damage to the documents being fed since it acts like a resilient spring on the documents. In addition it also minimizes mechanical noise during operation.

The scuffer wheel may be made of any suitable material. Typical materials include preformed foam elastomers having a coefficient of friction with the paper of from about 0.8 to about 1.5. Typically the foam is an open celled foam having from about 60 to about 80 cells per inch, a density of from about 4 to 6 pounds per cubic foot and a hardness of less than about 40 durometer. Foams having densities greater than about 6 pounds per cubic foot tend to induce mechanical noise into the system as a result of rubbing against the face plate indentation. Foams having less densities less than about 2 pounds per cubic foot exhibit slow memory, crowning and insufficient pressure over a period of time to feed documents without velocity slowdown or skewness. Foams harder than 40 durometer provide contact or shoe area which becomes too small for efficient sheet feeding. Ensuring both adequate contact area and structural integrity of the foam, the hardness preferably is from about 20 to 40 durometer shore A. Typically the foams have tear strengths greater than about 3.5 pounds and recovery time less than about one hundred milliseconds.

Particularly satisfactory materials which have high tensile and tear strength as well as having high resistives to abrasion and therefore being less likely to wear with use are the polyurethane foams. A flexible polyurethane foam roll about 0.88 inches in diameter supported on an inner support shaft about 0.18 inches in diameter and having a density of 4 pounds per cubic foot coefficient of friction with paper of between about 0.8 and about 1.2 and about 70 cells to the inch and a durometer of about 30 is particularly successful. Such material is commercially available from Tenneco Chemicals, Inc., Hazelton, Pennsylvania under the designation 8573H and W. T. Burnett & Co., Baltimore, Maryland under the designation Unifoam N4.0N. Both of these materials are ester type non-reticulated cell structure materials with relatively uniform structure. The registering and feeding apparatus is useful in registering and feeding a wide range of paper stock. It is particularly affective when used with stock ranging from 16 pounds to 32 pounds and varying in thickness from about 0.003 inches to about 0.0065 inches.

In accordance with this invention a semiautomatic document registering and feeding apparatus is provided which has the advantage of facilitating the feeding with accurate registration of documents by a casual operator. The necessity of the operator lining up one edge of the document against the registration member is eliminated in the feeding of individual documents. It only remains for the operator to casually insert the document in roughly the appropriate orientation into the nip formed between the deformable scuffer roll and the face plate to enable the flexible registering and feeding member of the present invention to accept the document and reorient the document being fed into a proper registration position and then forward to the operational zone.

The patents specifically referred to in this description are intended to be incorporated by reference into this application.

While this invention has been described with reference to the embodiments described it is not necessarily confined to the details as set forth and this application is intended to cover such modifications or changes as may come within the scope of the following claims.

What is claimed is:

1. A document registering and feeding apparatus comprising;

a face surface over which a document may be fed;

a first registration member adjacent a portion of said face surface and extending in a direction substantially parallel to the direction in which a document may be fed, said registration member being adapted to contact a first side of said document;

a flexible registration and feeding member for driving a document into registration engagement with the first registration member and for feeding a document in a direction substantially parallel to the first registration member, said flexible registration and feeding member comprising a rotatable flexible drive shaft having a generally cylindrical deformable scuffer roll fixed to one end of said flexible drive shaft, said flexible drive shaft being cantilevered over said face surface, angled vertically with respect thereto and angled horizontally with respect to said first registration member, said scuffer roll being in pressure contact with said face surface and adjacent to but spaced from said first registration member, and means to rotate said flexible drive shaft;

said end of said flexible drive shaft having said scuffer roll fixed thereto being unsupported whereby a small laterally unrestricted oscillatory motion is imparted to the scuffer roll when in feeding engagement with a document.

2. The apparatus of claim 1 further including;

a second registration member extending substantially normal to said first registration member and being adapted to contact a second side of a document being fed.

3. The apparatus of claim 2 wherein the distance in the feeding direction between the deformable scuffer roll and the second registration member is less than the length of the document to be fed.

4. The apparatus of claim 2 wherein said second registration member comprises the closed nip of at least one set of pinch rolls.

5. The apparatus of claim 1 wherein said flexible rotatable drive shaft is at a horizontal angle of from about 45° to about 75° to the side registration member, said angle being measured in the downstream document feeding direction.

6. The apparatus of claim 1 wherein said flexible rotatable drive shaft comprises a helical spring.

7. The apparatus of claim 1 wherein said cylindrical deformable scuffer roll comprises an open celled foam.

8. The apparatus of claim 7 wherein said foam comprises a porous polyurethane foam having a density of from about 4 to about 6 pounds per cubic foot.

9. The apparatus of claim 8 wherein said scuffer roll has from about 60 to 80 cells per inch.

10. The apparatus of claim 1 wherein said flexible registration and feeding means is positioned for simultaneously registering a sheet against said first registration member and feeding said sheet in a direction substantially parallel to said first registration member.

11. The apparatus of claim 1 including means to intermittently actuate said drive means to thereby enable intermittent registering and feeding of individual sheets.

12. The apparatus of claim 1 wherein said flexible registration and feeding means, said first registration member and said base surface are mounted to a frame.

13. The apparatus of claim 1 wherein said face surface has an uneven patterned surface.

14. The apparatus of claim 1 wherein said means to rotate said flexible shaft is positioned at the end of said flexible shaft opposite said deformable scuffer wheel.

15. The apparatus of claim 1 wherein said flexible rotatable shaft is at an angle of from about 20° to about 40° to the horizontal.

16. The apparatus of claim 15 wherein said deformable scuffer roll is deformed against the face plate, the area of contact forming a half moon shaped pattern.

* * * * *